US008746478B2

(12) United States Patent
Claeys

(10) Patent No.: US 8,746,478 B2
(45) Date of Patent: Jun. 10, 2014

(54) PORTABLE LIQUID STORAGE TANK

(76) Inventor: Jay V. Claeys, Bartlesville, OK (US)

( * ) Notice: Subject to any disclaimer, the term of this patent is extended or adjusted under 35 U.S.C. 154(b) by 1033 days.

(21) Appl. No.: 12/313,987

(22) Filed: Nov. 26, 2008

(65) Prior Publication Data

US 2010/0140263 A1 Jun. 10, 2010

Related U.S. Application Data

(63) Continuation of application No. 11/117,984, filed on Apr. 29, 2005, now abandoned.

(51) Int. Cl.

| | |
|---|---|
| ***B65D 25/28*** | (2006.01) |
| ***B65D 25/22*** | (2006.01) |
| *B65D 33/06* | (2006.01) |

(52) U.S. Cl.

USPC ..... 220/9.3; 220/9.2; 220/565

(58) Field of Classification Search

USPC ..... 220/9.1, 9.2, 9.3, 9.4, 565, 567.2, 220/567.3, 573; 4/488, 495, 494, 506, 585, 4/587

See application file for complete search history.

(56) References Cited

U.S. PATENT DOCUMENTS

| | | | | |
|---|---|---|---|---|
| 1,444,487 | A * | 2/1923 | Volters | 4/587 |
| 2,042,288 | A | 5/1936 | Bach et al. | |
| 2,624,054 | A | 1/1953 | Plant | |
| 2,678,768 | A | 5/1954 | Vergobbi | |
| 2,749,956 | A | 6/1956 | Eldred | |
| 3,396,885 | A | 8/1968 | Giondi | |
| 4,124,049 | A | 11/1978 | Yamaguchi | |
| 4,146,938 | A | 4/1979 | Shakas | |
| 4,393,531 | A * | 7/1983 | Hodel | 5/678 |
| 4,573,508 | A | 3/1986 | Knaus | |
| 4,585,159 | A * | 4/1986 | Travis | 229/166 |
| 4,989,749 | A * | 2/1991 | Choi | 280/47.34 |
| 5,024,344 | A | 6/1991 | Paula | |
| 5,090,588 | A * | 2/1992 | Van Romer et al. | 220/573 |
| 5,115,947 | A | 5/1992 | McDonnell et al. | |
| 5,244,281 | A | 9/1993 | Wiliamson et al. | |
| 5,429,437 | A | 7/1995 | Shaw et al. | |
| 5,437,384 | A | 8/1995 | Farrell | |
| 5,622,277 | A | 4/1997 | Van Giezen et al. | |
| 5,727,265 | A | 3/1998 | Ziegler et al. | |
| 5,733,552 | A * | 3/1998 | Anderson et al. | 424/754 |
| 5,746,343 | A * | 5/1998 | Waltke et al. | 220/9.4 |
| 5,762,233 | A | 6/1998 | Van Romer | |
| 5,803,650 | A | 9/1998 | Wu | |
| 5,897,012 | A | 4/1999 | Sortwell | |

(Continued)

FOREIGN PATENT DOCUMENTS

| | | |
|---|---|---|
| WO | WO 93/18690 | 9/1993 |

*Primary Examiner* — Mickey Yu
*Assistant Examiner* — Niki Eloshway
(74) *Attorney, Agent, or Firm* — Gable Gotwals

(57) ABSTRACT

A collapsible portable tank for storing liquids has a liquid impervious liner. The side walls of the liner are supported by a collapsible frame. A plurality of hand grips in a zigzag pattern on the floor panel of the liner facilitates manipulation of the liner to collapse the liner with the frame. The liner floor panel is of heavier material than the side walls and is heat sealed along its entire perimeter to the liner side walls, affording a more durable floor while eliminating clumsy excess liner material at the corners of the tank. Another hand grip on the floor panel opposite a drain in the liner side walls facilitates evacuation of stored liquid from the tank prior to collapsing the tank.

7 Claims, 3 Drawing Sheets

(56) References Cited

U.S. PATENT DOCUMENTS

| | | | | |
|---|---|---|---|---|
| 5,946,744 | A * | 9/1999 | Peterson | 4/506 |
| 6,021,915 | A | 2/2000 | Shimozono et al. | |
| 6,648,507 | B2 | 11/2003 | Joshi et al. | |
| 7,146,661 | B1 * | 12/2006 | Riehl | 5/93.1 |
| 7,188,747 | B2 * | 3/2007 | Bennett et al. | 220/565 |
| 2003/0029873 | A1 * | 2/2003 | Moffat et al. | 220/573 |
| 2005/0023282 | A1 | 2/2005 | Murrer, III | |
| 2005/0072779 | A1 * | 4/2005 | Christensen | 220/9.1 |

* cited by examiner

PORTABLE LIQUID STORAGE TANK

REFERENCE TO PENDING APPLICATIONS

This application is a Continuation of application Ser. No. 11/117,984, filed Apr. 29, 2005, and claims the benefit of that previously filed application.

BACKGROUND OF THE INVENTION

This invention relates generally to storage tanks and more particularly concerns collapsible portable tanks for storing liquids.

Collapsible portable tanks for storing liquids are well known and have changed very little over the years. They are, for example, often used by firefighters as a water reservoir at the scene of a fire. It is desirable that they can be quickly opened, emptied and collapsed by one or two workers, that they be lightweight but durable and that they be inexpensive.

Modern tanks have liners which include side walls and a floor panel which are made from a single sheet of material. The side walls are supported by a frame while the floor panel rests on the ground. Since the floor panel incurs the most significant abuse, the entire liner is made of material of sufficient weight to meet the requirements for the floor panel. This needlessly increases the total cost of the entire liner. Furthermore, since the sheet of material is folded to form the side walls and floor panel of the liner, excess pleats of material are created in each corner of the tank. The excess material adds unnecessarily to the weight of the liner and to the bulk of material that must be gathered in the collapsing process. The excess material is usually tri-folded and sewn, making the finished product neater and somewhat easier to handle but not reducing the weight of the liner at all. Sometimes the excess material is cut away in an effort to reduce this weight and bulkiness, but this compromises the integrity of the sheet and each of the corners must be separately sealed.

To empty a modern tank of its remaining contents before collapsing the tank, one or more workers must manually grip handfuls of the wet floor panel on one side of the tank and lift the liner to force the remaining liquid toward a drain on the opposite side of the tank. They are often wearing gloves and working in cold conditions. The floor panel, as it is pulled, creates a vacuum with the ground and resists the process. This is a clumsy, difficult task and often results in damage to the liner.

To collapse a modern tank, the workers must perform a similar task as described with respect to emptying the tank, further complicated by the need to simultaneously cause the tank frame to collapse while gripping and pulling on the wet floor panel. This is even more clumsy and difficult and further imperils the liner.

It is, therefore, an object of this invention to provide a portable liquid storage tank which can be quickly opened, emptied and collapsed by one or two workers. Another object of this invention is to provide a portable liquid storage tank which is lightweight. A further object of this invention is to provide a portable liquid storage tank which is durable. Yet another object of this invention is to provide a portable liquid storage tank which is inexpensive. It is also an object of this invention to provide a portable liquid storage tank which has side walls and a floor panel not formed from one sheet of material. Still another object of this invention is to provide a portable liquid storage tank which does not have excess pleats of materials in its corners. An additional object of this invention is to provide a portable liquid storage tank which has less bulk of material to be gathered during the collapsing process.

Another object of this invention is to provide a portable liquid storage tank which does not have corners compromised by cutting away excess material. A further object of this invention is to provide a portable liquid storage tank which does not require separate sealing of each of its corners. Yet another object of this invention is to provide a portable liquid storage tank which does not require gripping of handfuls of wet floor panel in order to empty or collapse the liner.

SUMMARY OF THE INVENTION

In accordance with the invention, a collapsible portable tank is provided for storing liquids. A liner of material impervious to the liquid to be stored has side walls and a floor panel. The side walls of the liner are supported by a collapsible frame.

One feature of the tank is the inclusion of a plurality of hand grips in the floor panel to facilitate manipulation of the liner to collapse the liner with the frame. Preferably, the collapse of the frame is enabled by hinges at its corners and hinges approximate the mid-points of two of its opposite sides. Most preferably, the hand grips are arranged in a zigzag pattern in relation to a vertical plane extending through the opposite side hinges with the first hand grips on each side of the floor being on opposite sides of the plane. This enables workmen on opposite sides of the tank to move the opposite side wall hinges inwardly while lifting successive hand grips with one hand and then the other so as to simultaneously collapse the frame and the liner as they move toward each other. The use of the hand grips significantly reduces the time of the collapsing process. A formerly 30 minute task, for example, can now be accomplished in 15 minutes.

Another feature of the tank is that its liner floor is a separate panel of heavier material than its liner side walls. The floor panel preferably is heat sealed along its entire perimeter to the side walls of the liner. This affords the benefits of a durable floor without increasing the weight and cost of the side walls while also eliminating either a clumsy excess of liner material at the corners of the tank or the labor involved in cutting the excess material away and separately sealing the corners.

A further feature of the tank is inclusion of a hand grip in the floor panel proximate the center of the side of the liner which is opposite a drain in the liner side walls. This facilitates evacuation of stored liquid from the tank prior to collapsing the tank.

BRIEF DESCRIPTION OF THE DRAWINGS

Other objects and advantages of the invention will become apparent upon reading the following detailed description and upon reference to the drawings in which.

While the invention will be described in connection with a preferred embodiment thereof, it will be understood that it is not intended to limit the invention to that embodiment or to the details of the construction or arrangement of parts illustrated in the accompanying drawings.

DETAILED DESCRIPTION

Figure 1:
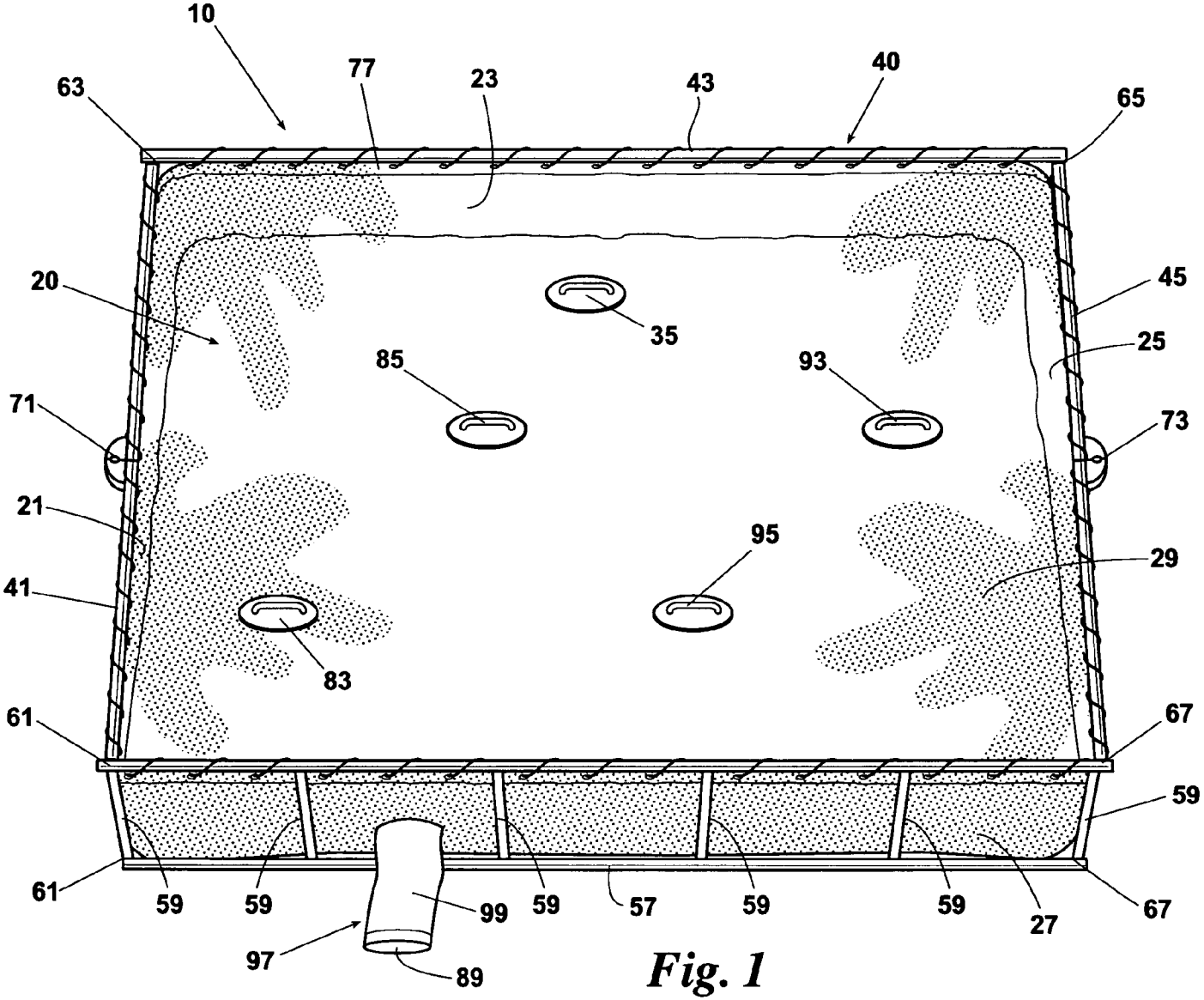
FIG. 1 is a top perspective view of a preferred embodiment of the portable liquid storage tank in the fully opened condition.
Figure 2:
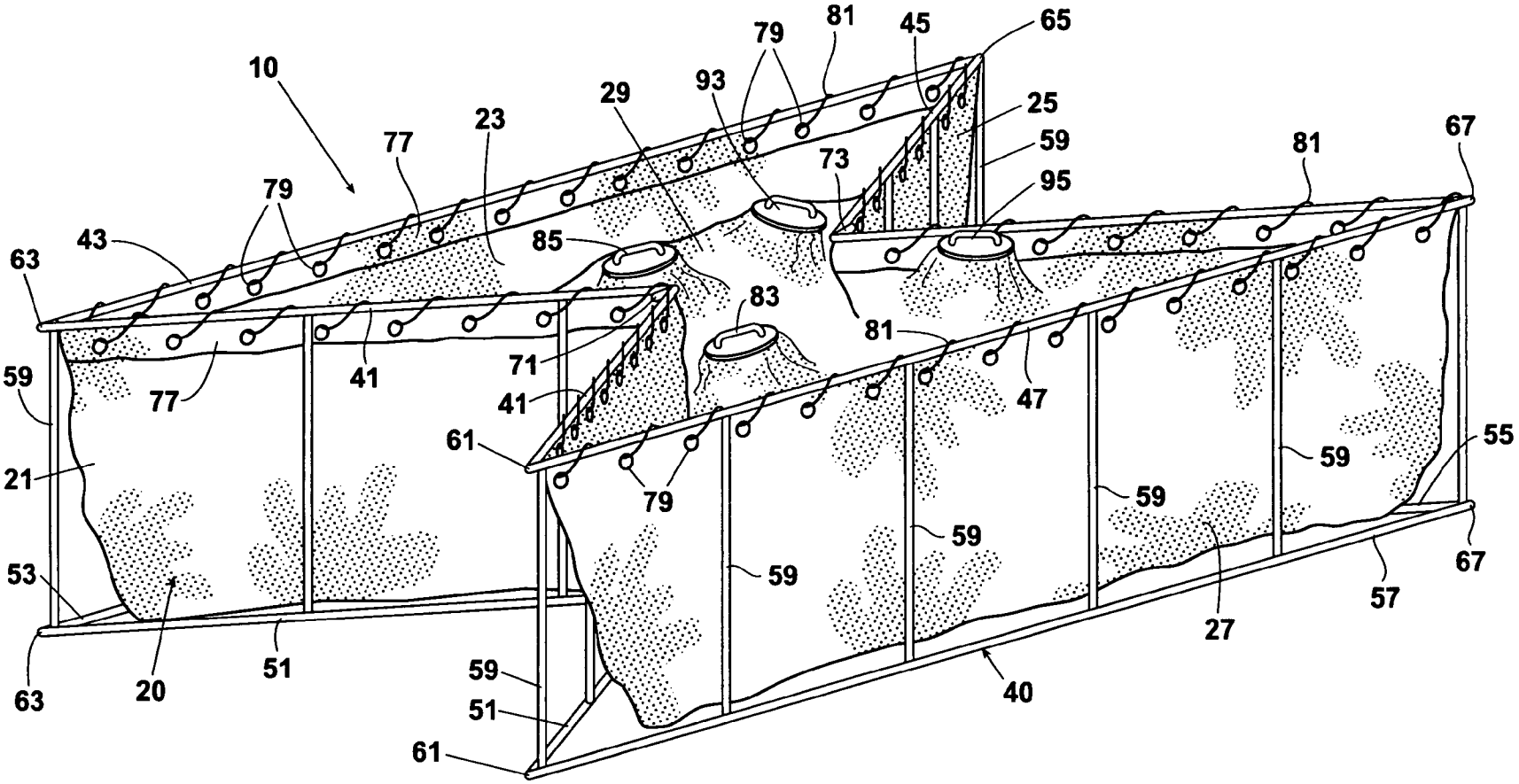
FIG. 2 is a top perspective view of the tank of FIG. 1 in a partially collapsed condition.
Figure 3:
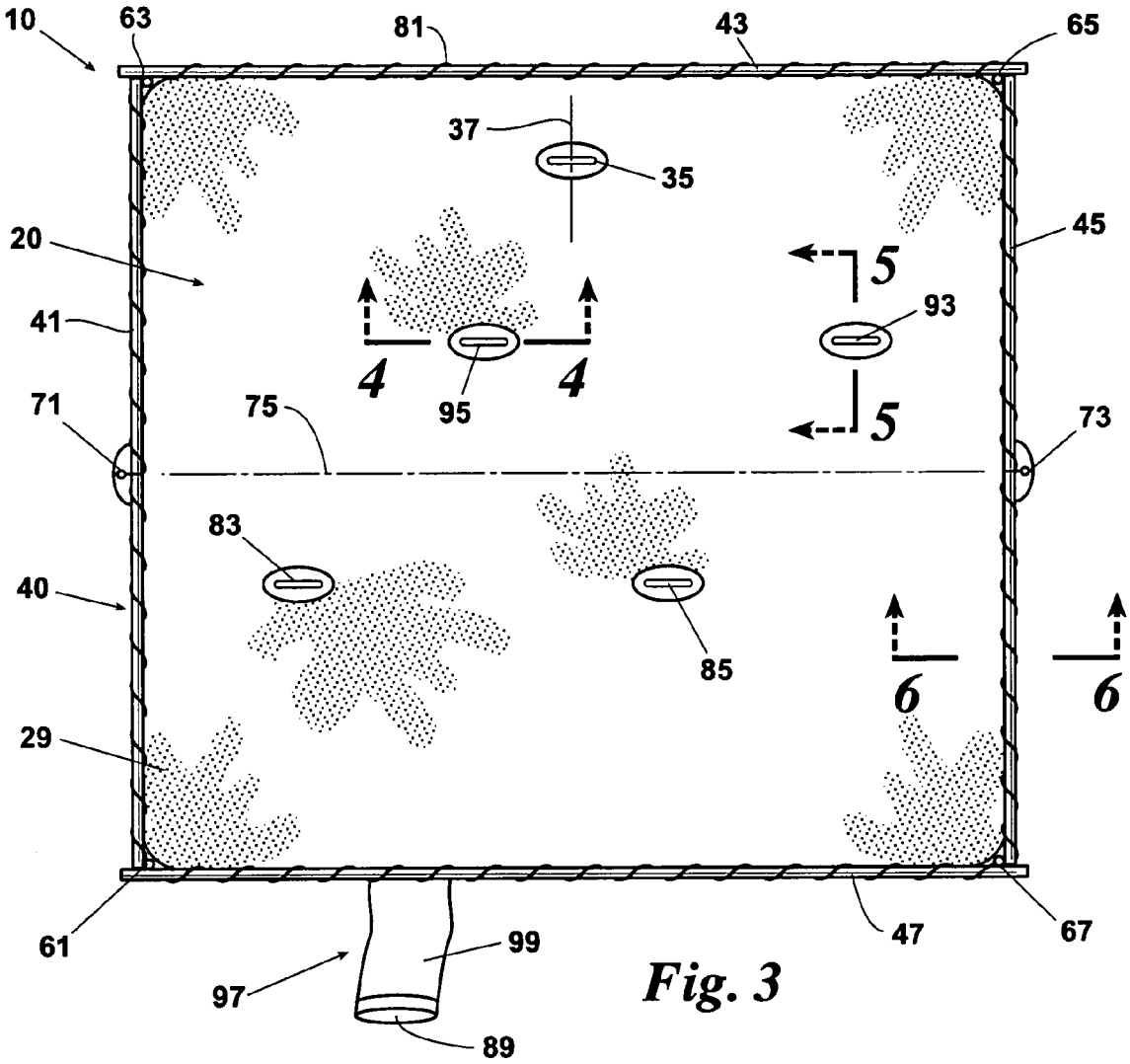
FIG. 3 is a top plan view of the tank of FIG. 1 in the fully opened condition.

Turning to FIGS. 1-3, a preferred embodiment of the collapsible portable tank 10 for storing liquids is illustrated. Such tanks 10 are typically, though not necessarily, square. They are usually about 30" high, from 6' to 18' on each side and hold from 500 to 5,000 gallons of water.

Figure 6:
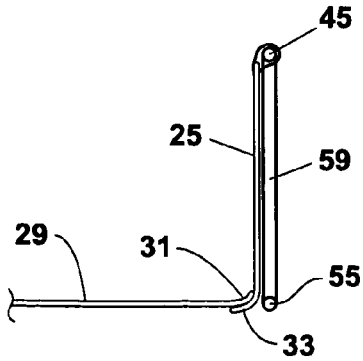
FIG. 6 is a cross-sectional view taken along the line 6-6 of FIG. 3.

The tank liner 20 is preferably made using PVC vinyl, but any material impervious to the liquid to be stored can be used. The liner 20 has side walls 21, 23, 25, 27 and a floor panel 29. The floor panel 29, which will be subjected to greater stress and abuse, is made of material heavier than the material of the side walls 21, 23, 25, 27. For example, for water storage tanks the floor panel 29 may be of 28 oz to 40 oz PVC vinyl while the side walls 21, 23, 25, 27 can be of significantly lighter material. As best seen in FIG. 6, it is preferred that the floor panel perimeter 31 overlap the lower edge 33 of the side walls 21, 23, 25, 27 and that the floor panel 29 and side walls 21, 23, 25, 27 be heat sealed along the entire perimeter 31 of the floor panel 29.

Looking at FIGS. 1 and 2, the side walls 21, 23, 25, 27 of the liner 20 are supported by a collapsible frame 40. As shown, the frame 40 consists of top 41, 43, 45, 47 and bottom 51, 53, 55, 57 rails spaced apart by vertical struts 59. Hinges 61, 63, 65, 67 at each of the corners connect the rails of the frame 40 and hinges 71, 73 approximately at the midpoints of the rails 41, 51, 45, 55 of two of the opposite sides allow those sides to fold in half. The midpoint hinges 71, 73 define a vertical plane 75, indicated in FIG. 3, approximately bisecting the tank 10. As best seen in FIG. 2, the hinges 61, 63, 65, 67, 71, 73 are oriented to rotate so that, as the midpoint hinges 71, 73 are moved toward each other along the vertical plane 75, the hinged rails 41, 51, 45, 55 fold and the other rails 43, 53, 47, 57 are drawn in parallel toward the vertical plane 75. The frame 40 be constructed, for example, using 1"×1"⅛" square aluminum tube or ⅞" by 14 gage round steel pipe, MIG welded as necessary, for the rails and struts. Tanks having frames of such components can be folded to a thickness of approximately 7".

Continuing to look at FIG. 2, the upper perimeter of the side walls of the liner is doubled over 77 and sewn for strength and fitted with grommets 79. A cord 81 is laced around the upper rails 41, 43, 45, 47 and through the grommets 79 so that the side walls 21, 23, 25, 27 of the liner 20 are supported by the upper rails 41, 43, 45, 47 of the frame 40. For example, #4 solid brass grommets on 6" centers have been found to work satisfactorily.

Figure 4:
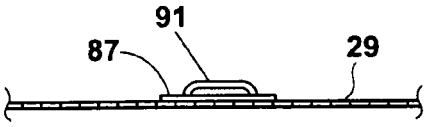
FIG. 4 is a cross-sectional view taken along the line 4-4 of FIG. 3.
Figure 5:
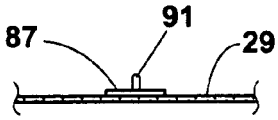
FIG. 5 is a cross-sectional view taken along the line 5-5 of FIG. 3.

Turning to FIG. 3, hand grips 83, 85, 93, 95 are provided on the floor panel 29 to facilitate manipulation of the liner. Preferably, the hand grips 83, 85, 93, 95 are arranged in a zigzag pattern in relation to the vertical plane 75. The first hand grips 83, 93 on each side of the floor panel 29 are on opposite sides of the vertical plane 75. This arrangement enables workmen on opposite sides of the tank 10 to move the opposite side wall hinges 71, 73 inwardly while lifting successive hand grips 83 and 85, 93 and 95 so as to simultaneously collapse the frame 40 and the liner 20 as they move toward each other. The grips 83, 85, 93, 95, as seen in FIGS. 4 and 5, may be approximately 6"×8"×3/32" oblong plates 87 supporting a handle 91 in a trowel-like configuration. The grips 83, 85, 93, 95 are preferably made of PVC and radio-frequency welded to the top surface of the floor panel 40. For most tanks, two grips 83 and 85, 93 and 95 are provided for each worker, as shown the first grip 83 or 93 for the worker's right hand and the second grip 85 or 95 for the left hand. In larger tanks, a third grip (not shown) for the right hand may be located on each side of the tank. By way of example, it has been found to be satisfactory to locate the grips of a 10'×10' tank approximately 18" on either side of the vertical plane 75 with the first and second grips 83 and 85, 93 and 95 on each side being approximately 20" and 48", respectively, away from their side walls 21 and 25.

Continuing to look at FIG. 3, a drain 97 is provided in one side 27 of the tank liner 20 for emptying the tank 10. The drain 97 may, as shown, be a 10" PVC tube 99 which is heat sealed to the liner side wall 27. The drain tube 99 is preferably closed by use of a D-ring (not shown) on the tube 99 which can be raised and engaged on a J-hook (not shown) on the top rail 47 so that the tube opening 89 is above the liquid level in the tank 10.

To facilitate emptying the tank 10, a grip 35 similar to those above described is located on the top surface of the floor panel 40 approximately on the center line 37 of the tank 10 which is perpendicular to the vertical plane 25 and approximately 12" from the side wall 23 of the liner 20 opposite the drain tube 99. This hand grip 35 can thus be lifted to raise the portion of the floor panel 40 proximate the grip 35 and cause the liquid to flow toward the drain 97.

Thus, it is apparent that there has been provided, in accordance with the invention, a portable liquid storage tank that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A manually raisable and collapsible portable outdoor tank comprising:

a foldable frame which, in an unfolded condition with a bottom of said frame resting on the ground, supports an upper perimeter of said frame above the ground;

a liner having pliant impervious sidewalls and a pliant impervious floor panel which, with said sidewalls suspended from said frame perimeter and said floor panel supported by the ground, form a collapsible container capable of storing a large volume of liquid; and a plurality of hand grips fixed to a top surface of the liner floor panel;

said frame being adapted to be folded by pushing by a worker of a joint of said frame toward a center vertical axis of said liner floor panel as the worker walks toward said axis and said plurality of grips being arranged in an array adapted to be alternately pulled by opposite hands of the worker to collect said liner as the worker walks toward said axis and said frame is folded.

2. A tank according to claim 1, said frame perimeter, said sidewalls and said floor panel being rectangular.

3. A tank according to claim 2, said frame being adapted to be folded into a top-to-top W-shaped configuration.

4. A tank according to claim 3, said array of hand grips being arranged in a zigzag in relation to a plane bisecting said Ws and extending through said center vertical axis.

5. A tank according to claim 1, said volume of liquid being in the order of approximately 500 to 5000 gallons of water.

6. A tank according to claim 1 further comprising a drain hole in a bottom of one of said sidewalls.

7. A tank according to claim 6 further comprising a handgrip fixed to said top surface of said floor panel proximate a sidewall of said liner opposite said drain sidewall.

* * * * *